United States Patent [19]

Lee

[11] Patent Number: 4,861,034

[45] Date of Patent: Aug. 29, 1989

[54] GOLF-GRIP TRAINING DEVICE

[76] Inventor: Sung Y. Lee, 99-639 Aiea Heights Dr., Aiea, Hi. 96701

[21] Appl. No.: 225,717

[22] Filed: Jul. 28, 1988

[51] Int. Cl.[4] ..... A63B 69/36

[52] U.S. Cl. ..... 273/183 D; 273/81.2; 273/81.4; 273/165; 273/DIG. 030

[58] Field of Search ..... 273/183 D, 186 A, 81 R, 273/81.2, 81.4, 165, 194 R, DIG. 030

[56] References Cited

U.S. PATENT DOCUMENTS 4,515,368 5/1985 Petitjean ..... 273/194 R

*Primary Examiner*—George J. Marlo

*Attorney, Agent, or Firm*—Dennison, Meserole, Pollack & Scheiner

[57] ABSTRACT

A golf grip training device designed to be readily attached and removed from the handle of a golf club. An elongated pressure sensitive switch is mounted on the underside of the handle and is responsive to the grip pressure of the golfer. The switch is formed of three resilient conducting strips adhesively secured to a number of spaced compressible foam blocks forming two sandwich layers. The switch is responsive to two distinct grip pressures. A signalling device containing a battery, a buzzer, and a grip pressure selector switch is mounted on the golf club and electrically connected to the pressures sensitive switch to emit an audible signal when a predetermined grip pressure is exceeded. The grip pressure selector switch can select either of the two grip pressure ranges built into the pressure sensitive switch.

10 Claims, 2 Drawing Sheets

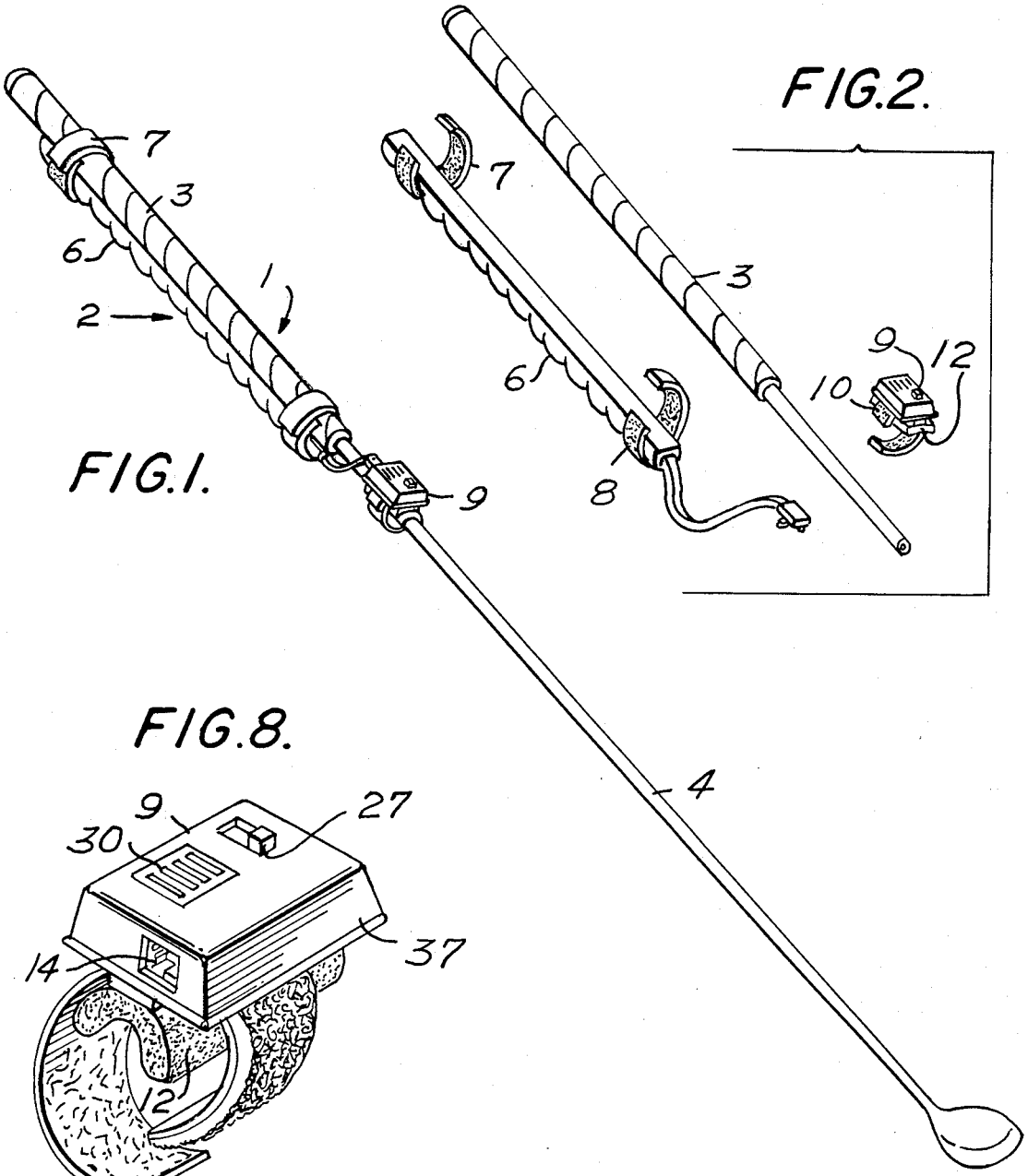
FIG.1.
FIG.2.
FIG.8.
FIG.7.
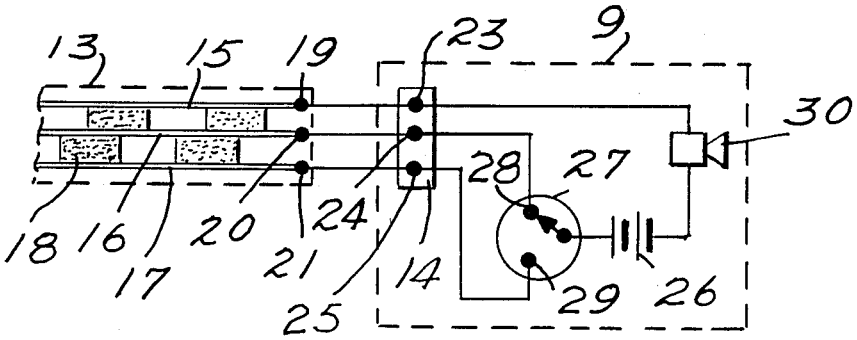

GOLF-GRIP TRAINING DEVICE

BACKGROUND OF THE INVENTION

This invention relates to a training aid which is readily attached to and detached from the handle of any golf club to assist the golfer in determining an optimum grip pressure. It is important to maintain a fairly light, even grip throughout the golf swing. A proper grip should generate a feeling of controlling the club and a sensing of the weight of the club head. The grip pressure should remain constant at all times during the set-up, back-swing and follow-through.

An excessively tight grip stiffens the forearms causing a retardation of the swing. An excessively loose grip creates other problems such as overswinging or brushing the ground prior to hitting the ball. Golfing experts recognize that a good grip is essential for any strategy to improve a player's golfing game.

A number of training aids for measuring a golfer's grip have been invented as typified by U.S. Pat. No. 4,138,118, issued Feb. 6, 1979 to David R. A. Budney; U.S. Pat. No. 4,103,896, issued Aug. 1, 1978 to Walter R. Lorang and U.S. Pat. No. 3,323,367, issued June 6, 1967 to R.W. Searle. The patent to Budney shows a golf grip employing strain gauges fixedly mounted on selected locations of the handle. The strain gauges are connected to a remote recorder which provides a series of graphs which can be compared to the graphs produced by an expert golfer. Lorang shows a golf grip training apparatus having a switch lever mounted on one side of the golf club handle. Excessive pressure exerted by the middle fingers of the off-target hand causes the lever to close a circuit to activate a signalling device mounted on the club. Searle shows a plurality of pressure sensitive sensors mounted on the handle of a golf club to respond to the grip pressure of both hands. The sensors are part of a bridge circuit which indicates grip pressure information on a meter attached to the club.

While the above mentioned patents do teach pressure responsive grips, the prior art does not teach a grip training device having the flexibility of attachment, the wide application and the feature of adjustability found in the instant invention.

SUMMARY OF THE INVENTION

The overall object of the present invention is to improve upon the prior art golf grip training devices by increasing the flexibility of usage and the range of application.

It is a specific object of the invention to provide a golf-grip training device that can be readily attached and removed from a golfer's own set of clubs. Although the invention may be permanently integrated into a golf club, it is primarily designed as a removable attachment for use at the option of the golfer. The fact that the invention can be attached to the golfer's own clubs makes it useable both for right-handed and left-handed golfers.

It is another object of the invention to provide a pressure grip indicator responsive to at least two specific pressures. The change in grip pressure response is brought about by means of an electrical switch in series circuit with a battery, a pressure sensor and an audible signalling device. The change in grip pressure range enables use by golfers with different degrees of muscular strength and different levels of proficiency and experience.

It is yet another object of the invention to provide an audible self-analysis of the pressure used to grip the club. An audible signal mounted on the golf club is to be preferred over a visual signal in that the golfer can keep his eye on the ball without distraction while the gripping pressure is monitored.

BRIEF DESCRIPTION OF THE DRAWINGS

FIG. 1 is a perspective view showing the apparatus of the invention mounted on a golf club;

FIG. 2 is an enlarged view of the handle portion of FIG. 1 golf club with the apparatus of the invention removed and in position for attachment;

FIG. 7 is a circuit diagram illustrating the electrical operation; and

FIG. 8 is a top view of the signalling device.

DESCRIPTION OF THE PREFERRED EMBODIMENTS

Figure 3:
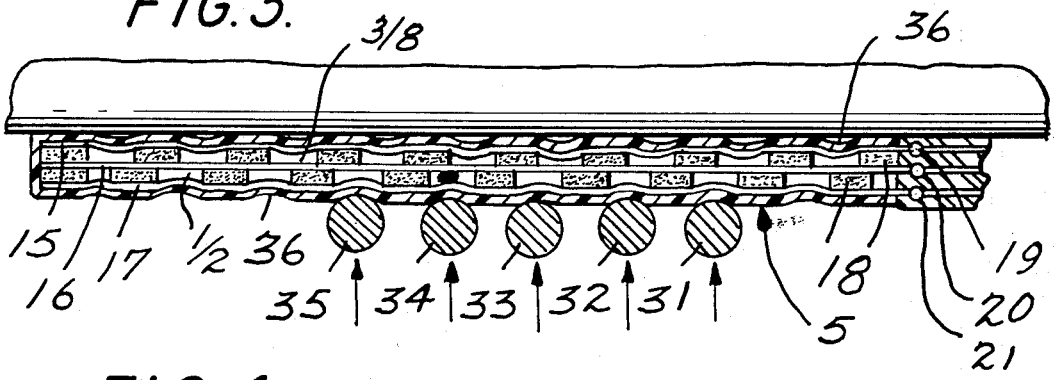
FIG. 3 is a perspective view of the pressure sensitive switch of the invention with the outer cover removed to expose the inner details.

Referring now in general to the drawings and in particular to FIGS. 1–3, the novel golf-grip training device 1 of this invention comprises a grip pressure sensing element 2 secured to the underside of the handle 3 of a golf club 4. The grip pressure sensing element 2 comprises a multi-level strip switch 5 encased in an elastomeric housing 6 to seal out dirt and moisture. Another important function of the elastomeric housing 6 is to provide the requisite flexibility to enable the pressure generated by the gripping fingers of the hands to be passed on to the internal strip switch 5. The housing flexibility also enables it to conform to the handle 3 of the golf club without creating any bulkiness.

Velcro straps 7 and 8 are mounted on end portions of the housing 6 of the pressure sensing element 2 to secure it in place on the golf club grip 3. As best seen in FIG. 2, the Velcro straps are permanently bonded to outside portions of housing 6 with the free ends of the straps in position to encircle the grip. The pressure sensing element 2 is then held against a bottom portion of the club grip and the Velcro straps tightly wrapped in locking arrangement around the handle 3 as shown in FIG. 1.

A signalling device 9 is mounted on the top side of the golf club 4 between the golf club head and the pressure sensing element as close to the sensing element as practical to conveniently electrically connect the two. The details of construction and operation of the signalling device 9 will be explained below in connection with FIGS. 7 and 8. It is sufficient to note at this time that the signalling device 9 is strapped to the golf club by means of a Velcro strap 10 clamped to the bottom of the signalling device by a clamping plate 11 fastened to the bottom plate of the signalling device. A half-cylindrical section of spongy material 12 of a length approximately equal to the length of the signalling device is bonded to the lower surface of the clamping plate 11. The purpose of spongy section 12 is to frictionally secure the signalling device to the golf club under pressure from Velcro strap 10.

After the pressure sensing element 2 and the signalling device 9 are mounted on the golf club the two are electrically connected by means of a quick connect electrical coupling. Although a wide variety of quick connect couplings may be used it is preferred to employ a modular phone jack as used in telephone service. A modular spade line cord 13 is connected to the output terminals of pressure sensor 2. A modular jack 14 is recessed in one end of signalling device 9 to receive the modular spade line cord 13 thereby completing the circuit. The connection can be easily disconnected when detaching the golf grip training device from the golf club.

Referring now to FIG. 3, the multi-level strip switch 5 is shown exposed to view after the elastomeric housing 6 has been removed. The switch 5 comprises an outer contact strip 15, a middle contact strip 16 and a bottom contact strip 17 separated by a number of blocks 18 of compressible material. The blocks 18 are made of a plastic foam with the opposed wide surfaces provided with an adhesive coating for bonding to the metal strips 15, 16, and 17. The foam blocks are adhesively bonded between the metal strips at spaced intervals to form a two-layer sandwich construction.

In a normal unstressed position the blocks 18 maintain the three resilient contact strips 15, 16 and 17 in spaced apart insulated relation. When pressure is applied to outer switch contact 15 electrical contact is made between 15, 16 and 17 depending upon the amount of applied pressure.

Although there is nothing critical in the precise dimensions of the parts or the materials employed, for the sake of explanation some exemplary dimensions and materials of construction will be given. The resilient contact strips 15, 16 and 17 are made of stainless steel and are about 8 inches long, $\frac{1}{4}$ inch wide and 0.005 inch thick. The compressible foam blocks 18 are $\frac{1}{4}$ inch wide, $\frac{3}{8}$ inch long and $\frac{1}{8}$ inch thick. The blocks are cut from foam strip material with adhesive on both sides. Different material from different manufacturers have differing resistance to compression. Through experimentation, a material with the desirable compressibility factor is selected to yield the desired pressure response. The blocks 18 are mounted in a partial overlapping relationship with each block in a sandwich being spaced approximately $\frac{1}{2}$ inch apart. The last space in each sandwich layer at the butt end location is somewhat less than $\frac{1}{2}$ inch as determined by experimentation.

At the strip switch 5 end remote from the butt end a series of terminals 19, 20, 21 are provided on contact strips 15, 16, 17, respectively. The exposed wires of modular spade line cord 13 are attached to these terminals. The terminals 19–21 and the line cord 13 attached thereto are sealed at an end portion 22 of elastomeric housing 5 where the line cord exits to prevent entry of dirt and moisture. The other end of line cord 13 is inserted in modular jack 14 of the signalling device 9 to complete the circuit.

The electrical operation will be explained in connection with FIG. 7. Terminals 19, 20, 21 of contact strips 15, 16, 17 respectfully, are connected by spade line 13 to contacts 23, 24, 25 in modular jack 14 when the spade line is inserted into the modular jack located in the housing of the signalling device 9. A battery 26 mounted within housing 9 supplies voltage to a two position grip pressure selector switch 27 having output terminals 28 and 29. Switch terminal 28 is connected to middle contact strip 16 via terminals 24, 20. Switch terminal 29 is connected to bottom contact strip 17 via terminals 25, 21. Outer contact strip 15 acts as a common line and is connected to a buzzer 30 via contacts 23, 19. Buzzer 30 is connected to battery 26 to complete the circuit.

In the switch 27 position shown in FIG. 7, voltage is supplied to middle contact strip 16. Gripping pressure applied to outer contact 15 beyond the compressibility level of blocks 18 will cause contact strip 15 to make contact with middle strip 16 to energize buzzer 30. This will signal the golfer that he has exceeded a first presettable gripping pressure. When switch 27 is set to energize terminal 29, a voltage is supplied to bottom terminal 17. Gripping pressure applied to outer contact 15 beyond the compressibility of blocks 18 in both switch levels will cause contact strip 15 to make contact with strip contacts 16 and 17 to energize buzzer 30. This will signal the golfer that he has exceeded a second higher presettable gripping pressure. The manner of gripping pressure switch actuation will be further explained below in connection with FIGS. 3–6.

Most golfing experts agree that there is an optimum gripping method for holding a golf club. For a right-handed golfer it involves holding the butt end of the handle in the left hand and applying the right hand so that the club shaft lies across the first joint of the four fingers. Reference is made to FIG. 1 of U.S. Pat. No. 4,138,118 to Budney for a showing and description of the preferred grip. In further analyzing the optimum grip it can be seen that gripping pressure on the golf club handle is supplied mainly by the last three fingers of the left hand and the two middle fingers of the right hand.

The important fingers controlling the grip are schematically shown as circles in FIG. 3 where 31 and 32 represent the middle fingers of the right hand and 33, 34, 35 represent the last three fingers of the left hand. Tightening of the grip fingers exerts gripping pressure in the direction of the arrows to compress the multi-level strip switch 5 against the golf club handle, not shown in FIG. 1. Also not shown in FIGS. 3–6 is the thin elastomeric housing which covers switch element 5.

Figure 4:
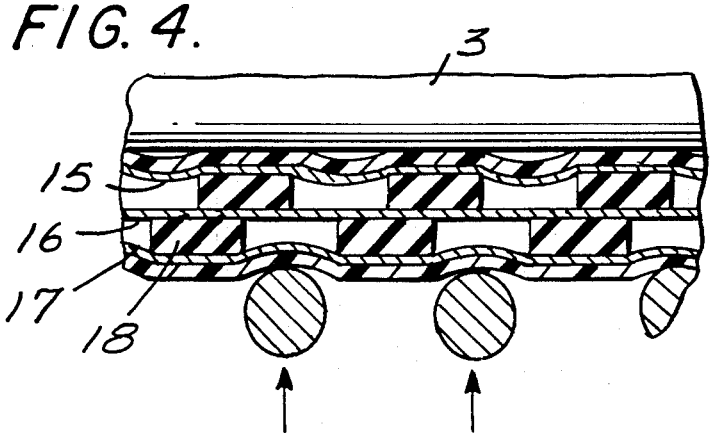
FIG. 4 shows a portion of the FIG. 3 switch in the normal unstressed condition.
Figure 5:
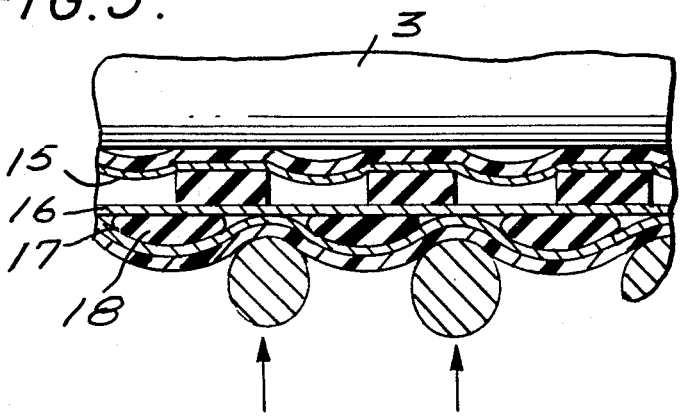
FIG. 5 shows the FIG. 3 switch in the first lighter grip stressed condition.
Figure 6:
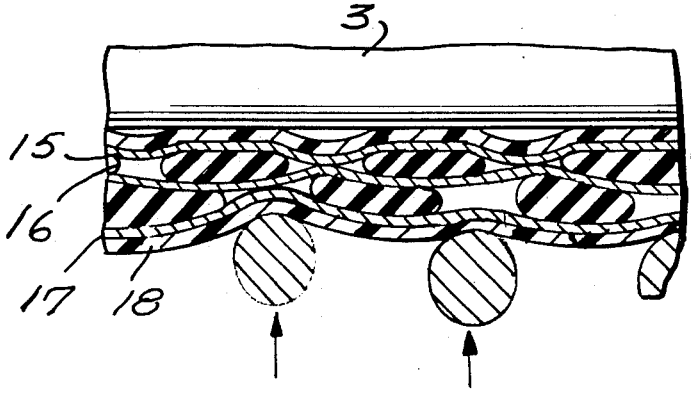
FIG. 6 shows the FIG. 3 switch in the second heavier grip stressed condition.

FIGS. 4–6 illustrate the three contact positions for multi-level switch 5. FIG. 4 shows a partial section of switch 5 with two gripping fingers operating thereon. A portion of the golf club handle 3 is shown for providing a reaction force. In the FIG. 4 position, no force is applied by the fingers and the switch is in an idle condition.

In FIG. 5, the two fingers shown apply a gripping pressure to outer contact strip 17 compressing blocks 18 and allowing deflection of strip 17 to contact middle contact strip 16. Assuming switch 27 is set on contact 28 for a low gripping pressure setting, the buzzer will sound indicating that the desired gripping pressure has been exceeded. The switch 5 has been designed to react to a low gripping pressure of 5 to 6 pounds.

In FIG. 6, a single gripping finger is shown applying a strong gripping pressure to outer contact 17 compressing blocks 18 at both levels and allowing deflection of outer strip 17 to contact middle strip 16 which in turn is deflected to contact bottom strip 15. Assuming switch 27 is set on contact 29 for a higher gripping pressure setting, the buzzer 30 will sound indicating that the desired higher gripping pressure has been exceeded.

The switch 5 has been designed in this mode to react to a gripping pressure of 14 to 15 pounds.

The undulations 36 shown in strip contacts 15 and 17 are formed by a slight permanent set in the strips across the open unsupported areas. They serve as convenient indexing recesses for the gripping fingers.

FIG. 8 shows the top portion of signalling device 9. All the components are mounted in a generally rectangular plastic housing 37 approximately 2 inches long, $1\frac{5}{8}$ inches wide and $\frac{5}{8}$ inch high. Grip pressure selector switch 27 is mounted on the top surface along with the output grille of buzzer 30. Modular jack 14 is situated on an end portion facing the golf club grip 3.

It is not intended to limit the present invention to the details of illustration or terms of description of the single preferred embodiment shown above. It will be appreciated by those skilled in the art that various modifications and alterations therein may be made within the scope of the present invention.

What is claimed is:

1. In a training device attachable to a golf club handle to signal a proper grip pressure, a grip pressure sensing element comprising a plurality of elongated resilient conducting strips separated by a plurality of spaced blocks of compressible material, said blocks of compressible material being adhesively bonded to said conducting strips, an electrical cable connected at one end to end portions of said resilient conducting strips, an elastomeric housing encasing said conducting strips, signalling means connected to the other end of said electrical cable, securing means connected to end portions of said elastomeric housing to secure said grip pressure sensing element to said golf club handle whereby said grip pressure sensing element is responsive to a predetermined grip pressure around the golf club handle as signaled by said signalling means.

2. The apparatus as claimed in claim 1 wherein said predetermined grip pressure signalled by said signalling means is a function of the compressibility of said spaced blocks.

3. The apparatus as claimed in claim 2 wherein said grip pressure sensing element comprises three resilient conducting strips, an outer strip, a middle strip and a bottom strip defining first and second sandwiches of spaced blocks of compressible material.

4. The apparatus as claimed in claim 3 wherein a first grip pressure applied to said outer strip compresses said first sandwich layer permitting said outer strip to contact said middle strip in the spaces between said blocks to define a first predetermined lower grip signal and wherein a second higher predetermined grip pressure applied to said outer strip compresses said first and second sandwich layers permitting said outer strip to contact said middle and bottom strips in the spaces between said blocks to define a second predetermined high grip signal.

5. The apparatus as claimed in claim 4 wherein said signalling means includes a separate housing detachably mounted on said handle close to the grip pressure sensing element, said housing containing a batter, a two-position grip selector switch, a modular jack, and a signal buzzer, said cable other end being insertable in said modular jack forming a signalling circuit.

6. The apparatus as claimed in claim 5 wherein said two-position grip selector switch includes a first position connecting said middle conducting strip to said battery and a second position connecting said bottom conducting strip to said battery, said outer conducting strip acting as a common line to complete the circuit.

7. The apparatus as claimed in claim 1 wherein said securing means comprises straps including hook and loop fasteners.

8. The apparatus as claimed in claim 5 wherein the means to mount said housing on said handle comprises a strap including hook and loop fasteners.

9. The apparatus as claimed in claim 3 wherein said first and second sandwiches of spaced blocks are arranged in partial overlapping relationship.

10. The apparatus of claim 1 wherein said grip pressure sensing element is adapted to be mounted on the underside of the golf club handle.

* * * * *